United States Patent [19]

Haneda et al.

[11] Patent Number: 4,492,456

[45] Date of Patent: Jan. 8, 1985

[54] DEVICE FOR DEVELOPING ELECTROSTATIC LATENT IMAGES

[75] Inventors: Satoshi Haneda; Masahiko Itaya; Minoru Tanaka, all of Tokyo, Japan

[73] Assignee: Knoishiroku Photo Industry Co. Ltd., Tokyo, Japan

[21] Appl. No.: 400,391

[22] Filed: Jul. 21, 1982

[30] Foreign Application Priority Data

Jul. 31, 1981 [JP] Japan ..... 56-121044

[51] Int. Cl.[3] ..... G03G 15/08

[52] U.S. Cl. ..... 355;3 DD; 355/14 D; 118/657; 430/122

[58] Field of Search ..... 355/3 DD, 14 D; 118/653, 657, 658; 430/122

[56] References Cited

U.S. PATENT DOCUMENTS

| | | | |
|---|---|---|---|
| 4,081,571 | 3/1978 | Nishihama | 355/3 DD X |
| 4,324,483 | 4/1982 | Tagawa et al. | 355/3 DD |
| 4,370,049 | 1/1983 | Kuge et al. | 355/3 DD |
| 4,377,334 | 3/1983 | Nishikawa | 355/3 DD |
| 4,395,112 | 7/1983 | Miyakawa et al. | 355/14 D |

*Primary Examiner*—A. C. Prescott

*Attorney, Agent, or Firm*—James E. Nilles

[57] ABSTRACT

An electrostatic latent image developing device having a non-magnetic carrier member for carrying a developer and fixed magnets installed inside said carrier member, and a regulating member disposed over the carrier member for regulating a developer layer thickness on the surface of the carrier member at a point between two peaks of a magnetic flux produced by two closely arranged magnets having same polarity inside the carrier member. The regulating member is a doctor blade and the carrier member is a rotatable cylindrical sleeve.

4 Claims, 4 Drawing Figures

DEVICE FOR DEVELOPING ELECTROSTATIC LATENT IMAGES

BACKGROUND OF THE INVENTION

1. Field of the Invention

The present invention relates to a device for developing electrostatic latent images which uses magnetic one-component developer and eliminates density variation on the copy when developed.

2. Description of the Prior Art

In electrostatic latent image developing devices using magnetic one-component developer, a regulating member for regulating a developer layer thickness such as a doctor blade is so set that the developer layer on a carrier member for carrying a developer such as a cylindrical sleeve at the doctor blade is about 0.2 mm in thickness.

The toner as the magnetic one-component developer readily forms lumps at high temperatures and humidity and when applied with pressure. The lumps of toner are caught in the clearance between the cylindrical sleeve and the doctor blade producing longitudinal lines or density variations on the developed image. Various poroposals have been made to prevent this. As a typical example the Japanese Patent Laid-Open No. 93177/1980 is presented here which employs a magnetic blade.Although this proposal slightly reduces difficulty encountered when installing the regulating member for regulating a developer layer thickness to required accuracy, it does not solve the basic problem, that is, formation of toner lumps at the blade and longitudinal density variation resulting from it. This problem still remains with reproducing machines currently on the market which uses magnetic one-component developer.

SUMMARY OF THE INVENTION

The object of this invention is to eliminate copy density variation that is caused by toner lumps caught by the doctor blade and to eliminate the difficulty in setting the doctor blade clearance to high accuracy.

The above object can be achieved by an electrostatic latent image developing device: in which fixed magnets are disposed inside a non-magnetic carrier member for carrying a developer; and a regulating member for regulating a developer layer thickness is disposed opposing the carrier member for carrying a developer at a point between two peaks of magnetic flux produced by two closely arranged magnets having the same polarity.

These and other objects and features of this invention will become apparent from the following description.

DESCRIPTION OF THE PREFERRED EMBODIMENTS

Figure 1:
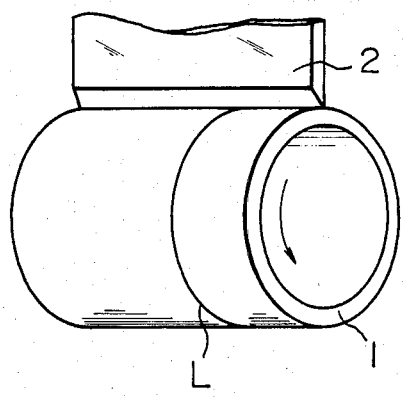
FIG. 1 is a perspective view of the development device showing a white line formed on the drum.

FIG. 1 is an explanatory view showing a white line formed on the photosensitive drum. The clearance between the outer surface of a development sleeve 1 as a carrier member for carrying a developer and a doctor blade 2 as a regulating member for regulating a developer layer thickness is set at about 0.1 mm to 0.5 mm. This clearance is much narrower than that used for the two-component developer. The one-component developer readily forms lumps especially at high temperatures and humidities.

These lumps of toner are caught in the clearance between the development sleeve 1 and the doctor blade 2, blocking the supply of toner thereby forming white lines L. In this way, the toner lumps causes density variation on the copied image.

To eliminate this problem, some proposals have been made, such as for providing a member to clean the doctor blade 2 or for breaking the lumps of toner and preventing the formation of toner lumps. But these methods are not decisive. In this invention two magnets with same polarity are arranged close to each other in a non-magnetic cylindrical sleeve 1, as shown in FIG. 2, and between the peaks of magnetic flux of the same polarity produced by the two closely arranged magnets the doctor blade 2 is disposed facing the cylindrical sleeve 1.

Figure 2:
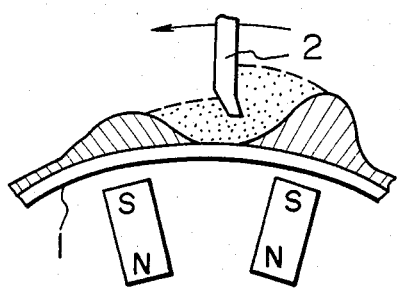
FIG. 2 is a cross-sectional view showing the carrier member and the doctor blade with two magnets having the same polarity arranged close to each other.
Figure 3:
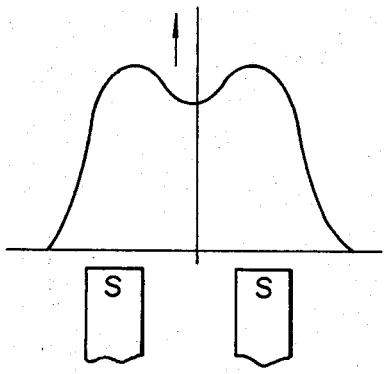
FIG. 3 is a graph showing the magnetic flux density for the arrangement shown in FIG. 2.

The magnetic flux distribution as shown in FIG. 3 is obtained when two magnets with the same polarity are placed close to each other as shown in FIG. 2. When the cylindrical sleeve 1 is at halt, two peaks of toner are formed, their magnitude depending on the gradient of magnetic field. Between these peaks there is an area where no toner is present.

When the cylindrical sleeve 1 is rotating, the toner is distributed according to variation of magnetiic field strength. Between the peaks of magnetic field strength the density of toner is low.

When lumps of toner or foreign matter that will form white lines on the developer layer are caught by the doctor blade 2 disposed above the circumference of the cylindrical sleeve 1 and enter the magnetic field as shown in FIGS. 2 and 3, they are absorbed in the low density toner thus preventing the formation of white lines.

Since the toner density at the central portion where the doctor blade is located is small and the region of low toner density expands upwards, the amount of toner passing under the doctor blade is small. This means that the clearance at the doctor blade can be increased, which in turn alleviates the difficulty in obtaining an accurate setting of the doctor blade and prevents the formation of toner lumps at the doctor blade.

In the magnetic flux distribution of FIG. 3, it is preferable that the dent portion between the two peaks be set in the range of 20% to 95% of the peak value. Our experiments show that setting the value of the dent portion at around 70% produces the best result. In this invention it is essential to place two magnets of the same polarity close to each other, as shown in FIGS. 2 and 3. The same effect can be obtained when a single magnet is cut at the central portion into U-shape as if two magnets of the same polarity were placed close to each other.

Figure 4:
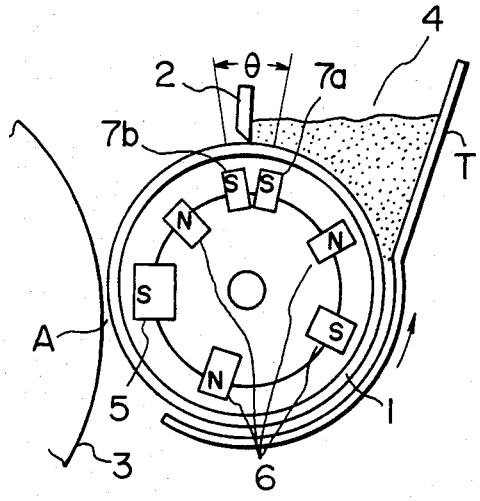
FIG. 4 is a cross-sectional view of one embodiment of this invention.

FIG. 4 illustrates one embodiment of this invention. Designated 1 is a non-magnetic cylindrical sleeve, 30 mm in diameter, that rotates in the direction of arrow at a speed of 300 r.p.m.

Designated 3 is a photosensitive drum coated with vapor selenium. Toner box T contains insulating one-component toner comprising 50 wt% of magnetite mixed with resin.

The clearance between the cylindrical sleeve 1 and the doctor blade 2 for regulating the developer layer thickness is set at 0.4 mm. The clearance between the photosensitive drum 3 and the cylindrical sleeve 1 is set at 0.3 mm to form a development area A.

Fixed permanent magnets are placed inside the cylindrical sleeve 1; at the development area A is disposed the south pole of a main magnet 5 and in other area there are toner carrying magnets 6.

At each side of the doctor blade 2 south pole magnets *7a, 7b* are disposed at the center angle $\theta$ of 15.

The magnetic flux density on the surface of the cylindrical sleeve 1 is 600 gauss at the crest of FIG. 3 and 300 gauss at the dent between the crests. The tip of the doctor blade 2 is positioned at the area of 300 gauss.

As the cylindrical sleeve 1 rotates, the insulating magnetic one-component toner coming from the toner supply portion 4 passes over the magnets *7a, 7b* disposed facing the doctor blade 2. Passing under the doctor blade 2, the toner is carried on the cylindrical sleeve 1 to the development area A where it develops the latent image on the photosensitive drum 3.

With this development device, it is possible to eliminate white lines as would be caused by lumps of toner caught by the doctor blade and therefore provide a good image without density variation, which in turn elongates the maintenance cycle. The device of this invention has another advantage of eliminating difficulty in setting the doctor blade to required accuracy.

When a single magnet of 600 gauss is used instead of two separate magnets *7a, 7b* of FIG. 4, the clearance between the doctor blade 2 and the cylindrical sleeve 1 must be set at 0.2 mm to obtain the same toner thickness regulating effect. With other settings of the clearance, white lines were observed on the cylindrical sleeve.

In the embodiment of FIG. 4, a satisfactory result is obtained if the peak magnetic flux density of magnets *7a, 7b* is in the range of 400 to 1500 gauss. There is no problem if there is a difference between the strength of magnets *7a, 7b* as long as they have the same polarity and the peak magnetic flux densities in the above range. The toner comprises at least 10% of a magnetic material and our experiments show that the use of 50 to 60% of magnetic material produces the best result. This invention is particularly effective when applied to the insulating magnetic one-component toner though it can also be applied to the two-component developer.

What is claimed is:

1. An electrostatic latent image developing device having a non-magnetic movable carrier member for carrying a magnetic developer from a source of supply of magnetic developer to a development area adjacent a photosensitive surface, fixed magnets installed inside said carrier member, said fixed magnets including two magnetic poles of the same polarity disposed adjacent one-another to provide two adjacent peaks of magnetic flux on the exterior of said carrier member, and a regulating member for regulating a developer layer thickness on the surface of the carrier member, said regulating member disposed over and spaced from the carrier member at a location between said source of supply and said development area and at a point between adjacent said two peaks of magnetic flux.

2. A device as defined in claim 1, wherein the magnetic flux distribution produced on the non-magnetic carrier member is such that when viewed in the direction normal to the surface of said carrier member, the valley between the two peaks of magnetic flux is in the range of 20% to 95% of the peak value.

3. A device as defined in claim 1, wherein said regulating member is a doctor blade.

4. A device as defined in claim 1, wherein said carrier member is a rotatable cylindrical sleeve.

* * * * *